US005427254A

United States Patent [19]

Knieriem

[11] Patent Number: 5,427,254

[45] Date of Patent: Jun. 27, 1995

[54] HOLDING DEVICE FOR SELF-STICK NOTE PADS

[76] Inventor: Gustave A. Knieriem, 712 Sylvan Ave., Cumberland, Md. 21502

[21] Appl. No.: 925,774

[22] Filed: Aug. 7, 1992

Related U.S. Application Data

[63] Continuation-in-part of Ser. No. 862,497, Apr. 2, 1992, abandoned, which is a continuation of Ser. No. 328,885, Mar. 27, 1989, abandoned.

[51] Int. Cl.[6] ..... B42D 17/00

[52] U.S. Cl. ..... 211/50; 248/205.2; 248/451; 211/59.2; 281/44

[58] Field of Search ..... 248/205.2, 205.3, 441.1, 248/504, 451, 452; 211/50, 13, 49.1, 59.2; 206/555, 451, 556; 281/34, 44, 45

[56] References Cited

U.S. PATENT DOCUMENTS

| | | | |
|---|---|---|---|
| 409,340 | 8/1889 | Unz | 281/44 |
| 1,077,537 | 11/1913 | MacMillan | 206/451 X |
| 1,806,950 | 5/1931 | Pratt | 281/44 |
| 1,953,568 | 4/1934 | Johnson | 248/452 X |
| 2,816,376 | 12/1957 | Hirvonen | 211/50 X |
| 3,232,397 | 2/1966 | McCoy | 206/555 X |
| 3,286,388 | 11/1966 | Makiri | 281/44 X |
| 3,764,167 | 10/1973 | Longarzo | 281/44 |
| 4,275,863 | 6/1981 | Hartman | 248/452 X |
| 4,585,145 | 4/1986 | Pitroda | 206/556 X |
| 4,605,292 | 8/1986 | McIntosh | 248/205.3 X |
| 4,650,141 | 8/1987 | Longo et al. | 248/205.3 X |
| 4,660,792 | 4/1987 | Rogalski | 248/205.2 X |
| 4,667,828 | 5/1987 | Samuelson | 206/555 |
| 4,696,399 | 9/1987 | Windorski | 206/565 |
| 4,767,093 | 8/1988 | Jones | 248/205.2 X |
| 4,852,746 | 8/1989 | Wells et al. | 248/205.2 X |
| 4,863,127 | 9/1989 | Handler | 248/205.2 |
| 4,964,519 | 10/1990 | Sugarman et al. | 211/50 |
| 5,080,254 | 1/1992 | Feer | 221/33 |

FOREIGN PATENT DOCUMENTS

| | | | |
|---|---|---|---|
| 12486 | 9/1909 | Denmark | 211/37 |
| 2056458 | 5/1972 | Germany | 211/50 |

*Primary Examiner*—Karen J. Chotkowski
*Attorney, Agent, or Firm*—Staas & Halsey

[57] ABSTRACT

A pad holding and dispensing device, utilizing one or more hook and loop, two sided adhesive or other fasteners to position a self-stick note pad in a secure and readily accessible dispenser. The fastener is connected between the spine of the note pad and an upstanding wall of the holder to augment in holding the individual sheets of the pad together and to hold the note pad within the dispenser. The holder can be transportable or can be mounted horizontally, vertically or any angle in between, and can be configured to hold multiple pads of similar or different sizes.

15 Claims, 4 Drawing Sheets

HOLDING DEVICE FOR SELF-STICK NOTE PADS

CROSS-REFERENCE TO RELATED APPLICATION

The present application is a continuation-in-part of application serial number 07/862,497 filed on Apr. 2, 1992 and now abondoned, which is a continuation of application Ser. No. 07/328,885 filed Mar. 27, 1989 and now abondoned.

BACKGROUND OF THE INVENTION

1. Field of the Invention

The present invention relates to pad holders, and in particular holders designed specifically to hold pads of self-sticking note paper.

2. The Prior Art Background

The self-stick pad, such as those sold under the trademark "Post-it" owned by 3M, which is now well-known was introduced in the late 1970's by 3M, after development of over a decade.

Post-it notes have gained almost universal, widespread acceptance and are currently utilized in a multitude of situations for a multitude of uses. However, some difficulty has been experienced when writing on the self-stick note pads. The pad alone presents a small unsecured surface. It is often difficult to write on the small note pad. The note pad can move about as the user attempts to scroll his message upon it. Movement of the pad can be curtailed by holding the pad with a non-writing hand, however, this ties up both hands when writing a note. As those notes are often utilized to take phone messages or while performing other tasks which require the user to utilize his free hand to hold the phone or perform an accompanying task, it is often inconvenient if not impossible to hold the note pad with the user's other hand.

As a first attempt to control a self-stick note pad, users would often remove the non-adhesive back sheet which comes with the pad and stick the pad down to a desk surface or other convenient surface utilizing the stickem of the bottom sheet to immobilize the pad.

Also, a number of note pad holders have been introduced in an attempt to create a means for securing the note pad. The note holders prior to the present invention fall short of providing satisfactory securing of the note pad. The holders often utilize the stickiness of the final sheet to keep the note pad in place within the note pad holder. Additionally, the note pad holders are weighted so that they will stay immobilized on a desk top surface without the need to be held by the user, however, this often renders the holders undesirably bulky.

These note holders can provide a temporary solution to immobilizing the sticky note pad, however, after a short period of time the stickiness of the bottom exposed sheet will give way and the note pad will once again become mobile. The bottom sheet can again be removed and the pad stuck down again, however, this is a solution which must again and again be implemented and which provides only temporary relief for the mobility of the pad. So far, the industry has not been able to develop, devise or provide a note pad holder which will provide secure adequate immobilization of the note pad over a significant period of time with any degree of reliability.

Because of the inability to provide effective utilization of the pads, a number of dramatic restrictions in the market of self-stick notes has plagued the industry. A comparison between the present uses of self-stick notes and the existing uses of non-stick note pads demonstrates that the use of self-stick note pads has been limited.

Self-stick note pads and non-stick note pads are constructed in a significantly different manner. Self-stick note pads are held together solely by the stripe of semi-adhesive on the top back of each page. Non-stick note pads are held together by a wide band of adhesive across the top of each page which usually also bonds a rigid piece of cardboard to the back or spine of the pad.

Due to these differences in construction, it has proved much more difficult to provide a suitable holder for self-stick note pads. There is no hard cardboard back to use as a mounting member and a self-stick note pad can easily come apart if placed in the wrong type of holder or mounted in an inappropriate manner.

Note holders have been designed which include a pocket for insertion of the back flat of the self-stick note pad, however, the adhesive of the pages of the pad have proved to be of insufficient strength to maintain the remainder of the pad adhered to the back sheet and the pad will often fall from the holder.

No note pad holder developed which relies upon the stickiness of the self-stick glue utilized to hold the pages together has been able to provide any sort of mounting at an angle, all of these holders necessarily holding and mounting the pad either flat or at a very slight angle to horizontal. When tilted at any significant angle, the note pad separates and falls from the holder, the weight of the note pad alone overcoming the adhesiveness of the self-stick glue. Having a bulky or weighted note holder which must orient the pad horizontally or near to a horizontal position provides for difficult writing on the pad as the pad is at a level above the level of the desk requiring an unnatural arch of the hand in order to write on the pad.

SUMMARY OF THE INVENTION

It is an object of the present invention to provide a self-stick note pad holder which is as at least as convenient in use as the self-stick note pad alone.

It is another object of the present invention to provide a holder for a self-stick note pad that holds a self-stick note pad within the holder regardless of the condition of the note pad and without the need to utilize the self-stick properties of the pad itself.

It is yet another object of the present invention to provide a self-stick note pad holder which allows for ease of use and ease of writing on the note pad without the user needing to hold the pad or holder with a second hand.

It is a further object of the present invention to allow ease of use of the entire sheet surface of a self-stick note pad by providing a convenient portable holder which can temporarily immobilize the note pad while in use.

It is yet a further object of the present invention to provide a desk top note pad holder which will allow ease of use of self-stick note pad without incumbering the user by a bulky oversized or weighted pad holder but while providing temporary immobility of the pad.

It is yet still another object of the present invention to provide a wall mounted note pad holder which allows ease of use of self-stick note pads mounted in a vertical orientation without the note pad falling from the holder or coming apart under its own weight.

It is an object of the present invention to provide a self-stick note pad holder which can be mounted at any desired angle and still securely retain the note pad.

It is another object of the present invention to provide portable, pocketable note pad holder.

It is yet another object of this invention to allow a self-stick note pad to be mounted inside the front cover of a binder or the inside cover of a pocket organizer or other similar device and for the note pad to remain secure when in normal use.

The present invention accomplishes these and other objects through the provision of a holder which engages each sheet of the note pad along the spine of the pad in a non-obstructing manner to provide positive holding without reliance upon the pad's adhesive qualities. The accomplishment of these objects will become apparent to the skilled artisan from the following detailed description when taken in conjunction with the following drawings in which the following is illustrated.

DETAILED DESCRIPTION OF EXEMPLARY EMBODIMENTS

Figure 1A:
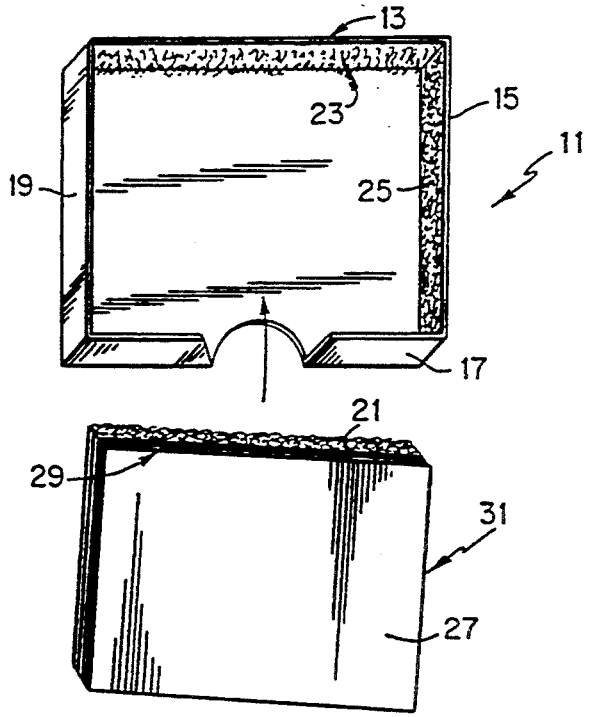
FIG. 1A is a top perspective view of a first embodiment of the present invention configured for accommodation of a single note pad.

As illustrated throughout, the holder is designed to retain the pad firmly in place. With respect to FIG. 1A, the embodiment of the holder 11 illustrated therein is provided with a base 12 and four upstanding walls 13, 15, 17 and 19. As shown in FIG. 1A, the upper wall 13 and right side wall 15 are provided on their inner surfaces with one portion of a fastener structure, such as a hook and loop type fastener like that sold under the mark "VELCRO", these strips are designated by 23 and 25 respectively. VELCRO fastener is a pressure sensitive fastener which utilizes complementary hook and loop members well known in the art. A strip of VELCRO fastener 21 complementary to strip 23 is provided along the top edge or spine 29 of the pad 27. The right edge 31 of pad 27, not visible in the illustration, is not provided with VELCRO fasteners. The VELCRO fastener strips can be adhered to the holder 11 and the pad 27 in any appropriate manner. For example, the strips could be sewn onto the interior of the holder and/or formed as an integral part of the holder. The strips can be provided with adhesive backing and then adhered to the holder or the pad.

In the embodiment illustrated, strip 23 is comprised of the hook half of VELCRO fastener while strips 25 and 21 are comprised of the loop half. It is important that strip 25 is formed of loop VELCRO fastener because the main engagement effect of strip 25 is frictional and the loop portion of the VELCRO fastener provides greater frictional effect. In this regard, it is important that the dimension of holder 11 between walls 19 and 15 should be such that VELCRO fastener portion 25 is compressed slightly when the pad 31 is inserted. The respective VELCRO fastener portions 21 and 23 could, of course, be reversed. However, it is desirable to retain consistency for ease of manufacture and interchangeability of pads.

Figure 1B:
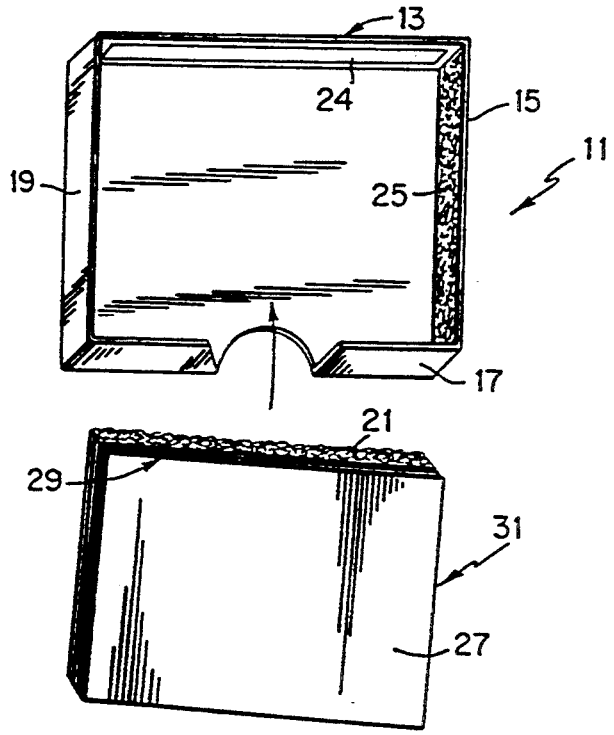
FIG. 1B is a top perspective view of an alternative first embodiment of the present invention configured for accommodation of a single note pad.

As illustrated in FIG. 1B, the hook and loop type fastener structure can be replaced with an adhesive material or structure, such as a double sided tape, for example, which can have, for example, a flat or a foam core. The pressure sensitive tape structure will act to secure the pad in the same manner as the hook and loop type fastener. It is to be understood that throughout the description of exemplary embodiments herein, an adhesive structure or other retaining structure can be substituted for the hook and loop fastener structure even if such substitution is not specifically described. As an example, an adhesive structure with a more aggressive side attached to the pad spine 29 and with a less-aggressive side attached to the holder could be utilized. Alternatively, strips with equal side aggressiveness could be utilized. The adhesive strips 24 may be reusable or may be replaced with each pad change. The strip 21 could be supplied already attached to the pad spine 29 or as an additional element to be positioned by the user. The adhesive would be provided with a removable protective covering to maintain the adhesive qualities prior to application.

Figure 2:
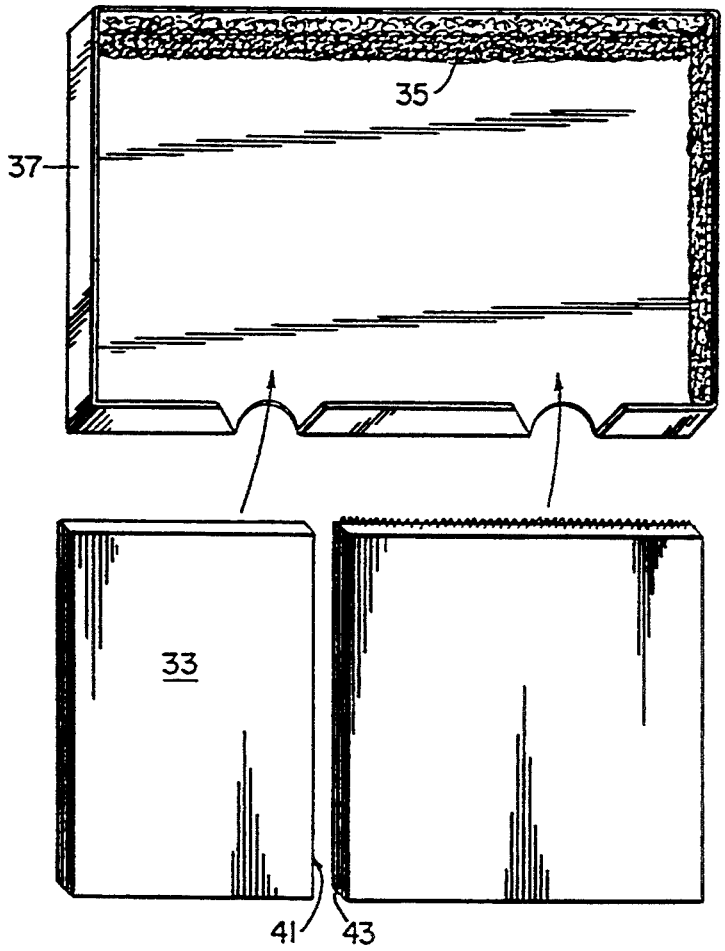
FIG. 2 is a top perspective view of an alternative embodiment of the present invention configured for accommodation of two note pads.

Alternatively, as illustrated in FIG. 2, the pad 33 can be provided without VELCRO fastener. In this case, it is desirable to comprise the top strip 35 of loop VELCRO, as illustrated.

Referring again to FIG. 1A, as pad 27 is inserted into holder 11 the complementary VELCRO fastener sections 21 and 23 will engage and act to secure the pad in place within holder 11. VELCRO strip 25 will also compress slightly so as to secure pad 27. VELCRO strip 25 also independently engages each sheet of the pad, thereby holding the individual sheets in place without reliance upon the adhesive properties of the pad. The action of strip 25 also acts to bolster the integrity of the pad and thereby hold the pad together. The pad therefore does not separate into individual sheets or fall from the holder 11 under the effects of its own weight.

The interior dimensions of the holder 11 are only minimally larger than the exterior dimensions of the pad 27 to be retained therein. The close tolerance of these dimensions will assure positive engagement of the VELCRO members and provide the necessary compression and frictional engagement between strip 25 and the sheets of the pad 27. The strip 25 also serves to push the pad against opposite wall 19 with exacting pressure, while bottom wall 17 serves to push strips 21 and 23 into engagement. The positive securing of the pad 27 within holder 11 will ensure that the lower edge of the pad will not move free of the holder. It has been found that for the illustrated embodiments, a spacing between the holder 11 and the note pad 27 of 1/64 to 1/32 of an inch before application of the VELCRO strip has provided satisfactory securance, once the VELCRO strip is in place.

Once secured in the holder 11, the note pad is neither buckled nor distorted, thereby providing a desired flat writing surface. Further, the removal of individual sheets is not hindered by placement within the holder 11. The entire original writing surface of the note pad remains for utilization.

It is preferred to mount the secondary strip 25 on the right hand side of the holder to aid in the removal of individual sheets by the user. Since the majority of users are right handed, it is natural to grasp the lower left hand corner to remove the sheets. By placing the VELCRO strip 25 on the right hand side, the left hand side is free to be raised first, thereby aiding removal of individual sheets when desired. It is of course contemplated within the teachings of the invention to place the strip 25 on the left hand side and may in fact be desirable for left handed users for the reasons stated above.

With respect to the embodiment of FIG. 2, as mentioned above, the left pad 33 does not have a VELCRO strip along its top edge and is therefore held in the holder 37 by frictional engagement. This does not provide as secure a retention as the positive locking of VELCRO fastener to VELCRO fastener.

Figure 3:
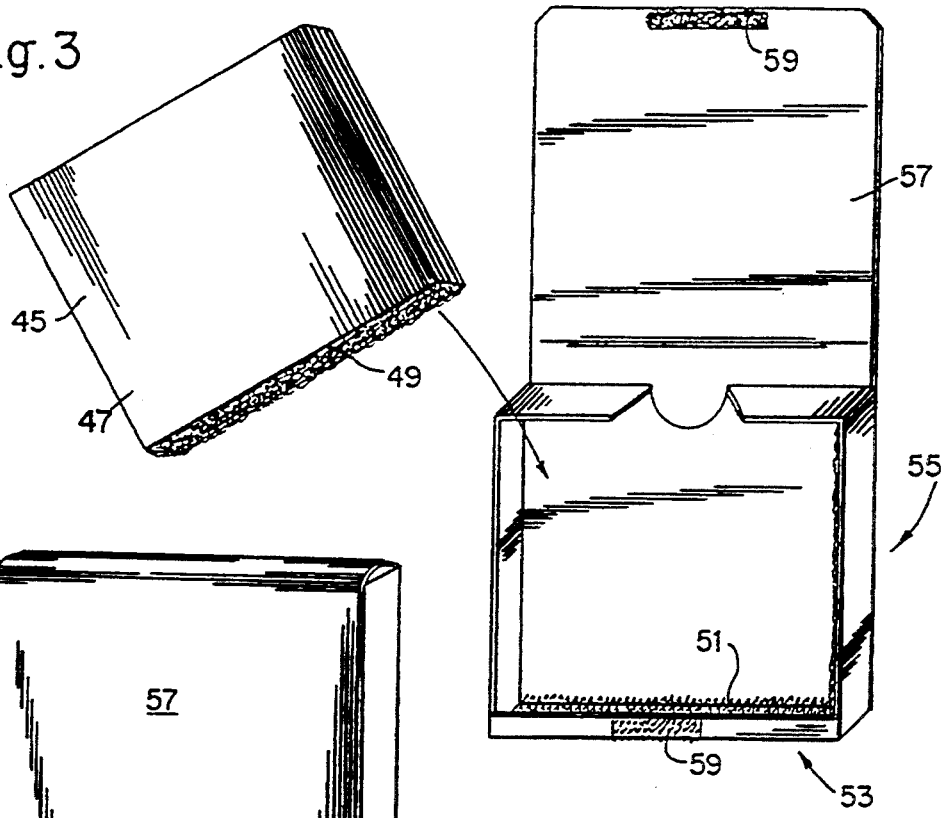
FIG. 3 is a top perspective view of an alternative embodiment of the present invention configured for accommodation of a single note pad.
Figure 4:
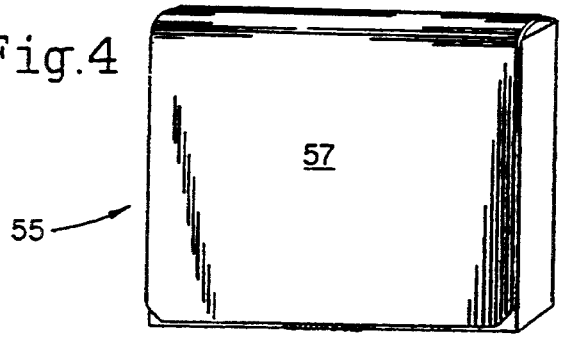
FIG. 4 is a top perspective view of the embodiment of FIG. 3, with the flap closed.

The holder 37 of FIG. 2 is configured for holding two pads of different dimensions. This allows the user to have a choice of sheet sizes in a single holder. A notch 39 is provided for each pad to allow ease of sheet removal. Retention of the pads is as described above, with opposing edges 41 and 43 of the pads held in close abutting relationship when inserted into the holder. In the embodiment illustrated in FIGS. 3 and 4 the pad has been rotated so that the semi-adhesive portion of the pad 45 is at the lower area 47 of the pad. Therefore the strip 49 is applied to the lower edge of the pad, and the complementary strip 51 is located on the inner surface of the lower wall 53 of the holder 55. The embodiment as illustrated has also been provided with a flat 57 for covering the pad 45. VELCRO closure means 59 has been illustrated for securing the flap, however, other known means such as snaps or buttons can be used.

The pad 45 is secured in holder 55 in the manner detailed above. This embodiment provides for portability while maintaining the top sheet in usable condition.

Figure 5:
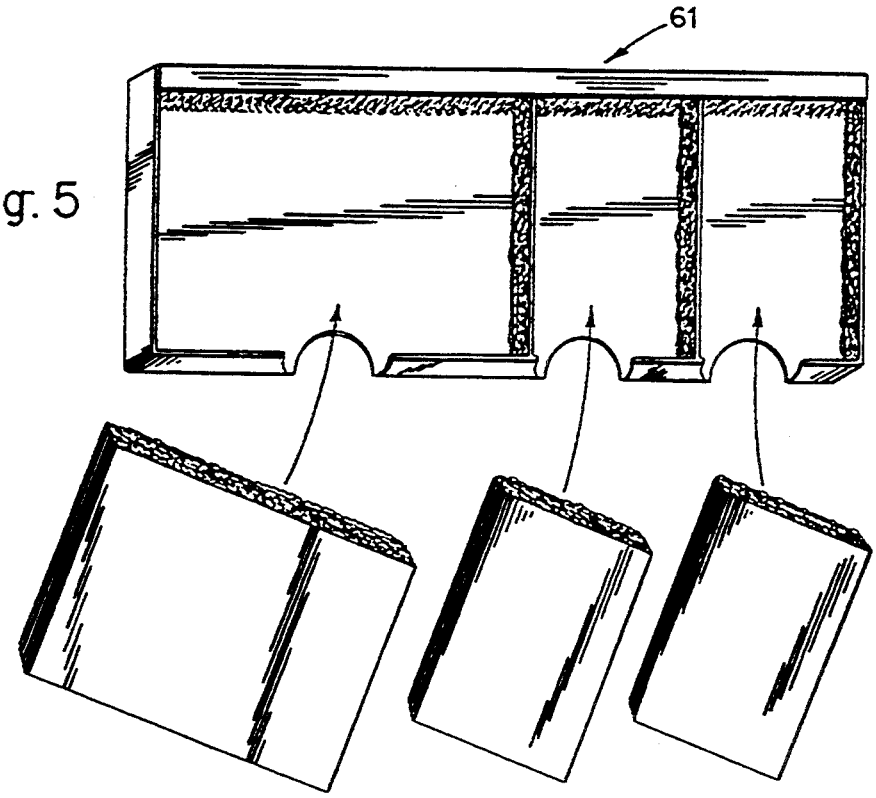
FIG. 5 is a top perspective view of an alternative embodiment of the present invention configured for accommodation of three note pads of differing sizes.

FIG. 5 illustrates a holer 61 configured for accommodation of three pads. This embodiment differs from the multiple pad holder of FIG. 2 because each pad is provided with a separate isolated compartment. There are no interabutting surfaces of adjacent pads. This allows for independent mounting and for removal of any pad without interference with the remaining pads.

Figure 6:
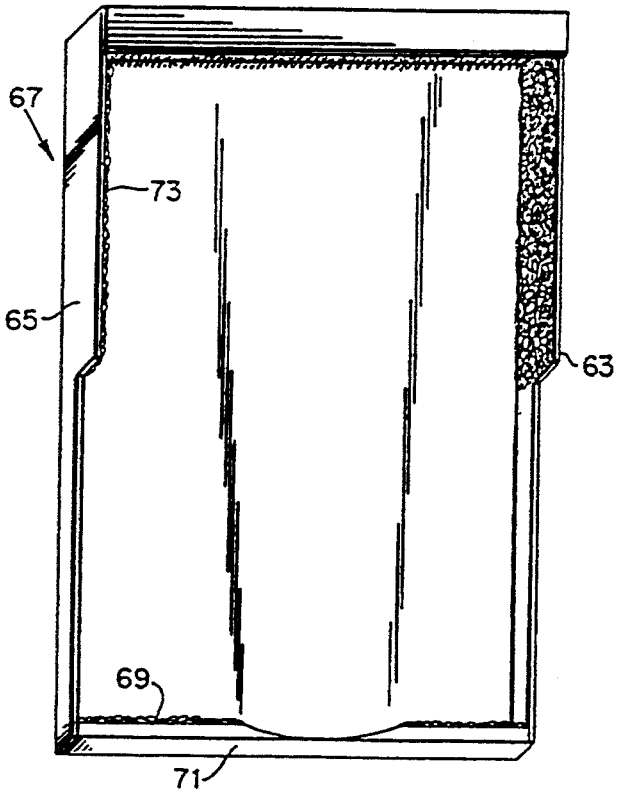
FIG. 6 is a top perspective view of an alternative embodiment of the present invention configured for retaining a single note pad.

FIG. 6 illustrates an embodiment of the present invention wherein the side walls 63 and 65 of the holder 67 are diminished at the lower portion to provide easier access to the sheets of the pad. This figure also illustrates the provision of a VELCRO strip 69 along the inside of the bottom wall 71 of the holder 67. This strip 69 adds to the securance of the pad and to the maintenance of the integrity of the pad through engagement of the individual sheets.

FIG. 6 further illustrates the provision of a strip 73 along the inside of left side wall 65. This strip 73 can be provided to also add to the securance of the pad. Either or both strip 69 and/or 73 can be added to any of the embodiments illustrated if desired.

Figure 7:
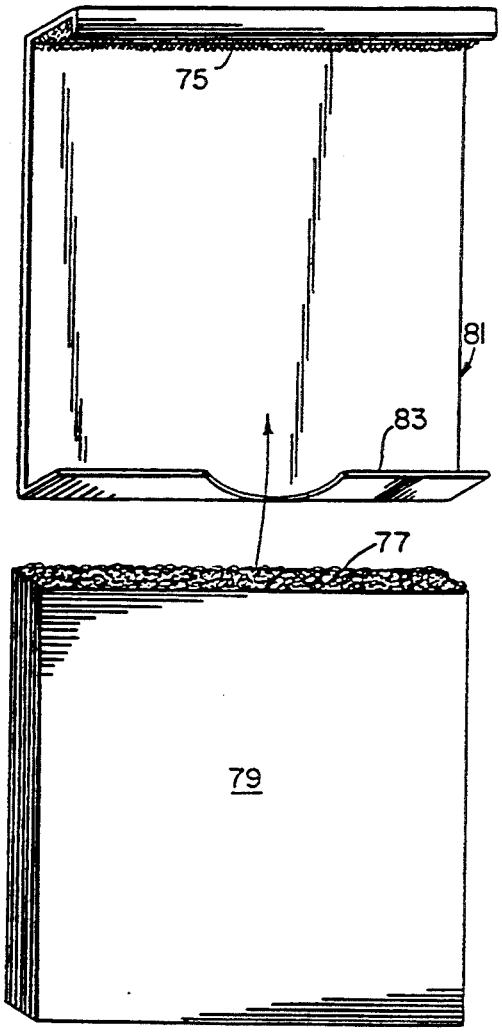
FIG. 7 is a top perspective view of an alternative embodiment of the present invention configured without side supports.

FIG. 7 illustrates an embodiment of the present invention without side walls. The embodiment includes VELCRO strip 75 and complementary strip 77 attached to pad 79. Holder 81 is also provided with bottom lip 83 to maintain engagement of VELCRO strips 75 and 77.

Figure 8:
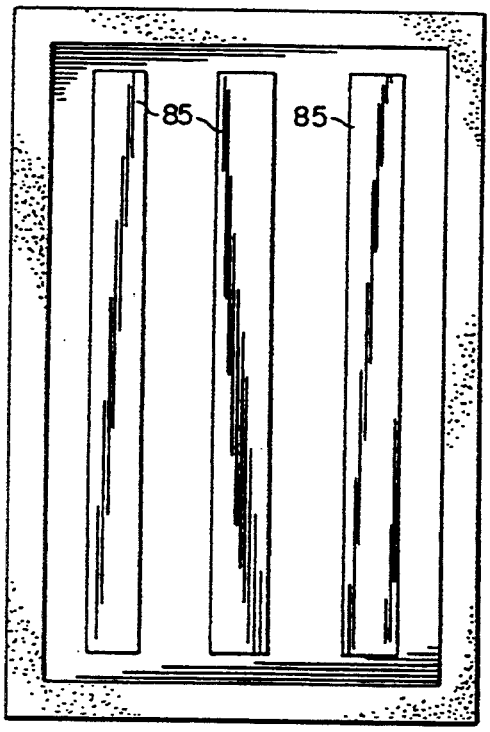
FIG. 8 is a back planar view of the present invention illustrating a wall mounting configuration.
Figure 9:
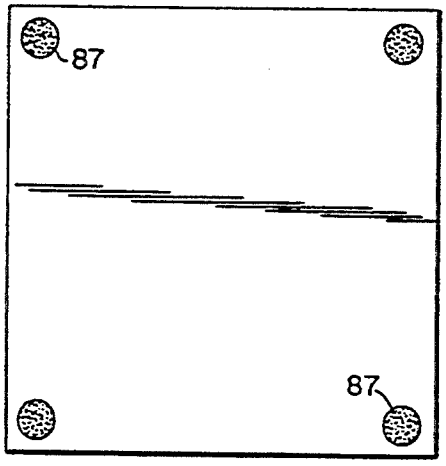
FIG. 9 is a back planar view of the present invention illustrating horizontal or near horizontal surface mounting.

FIGS. 8 and 9 illustrate various provision for mounting the holders. In FIG. 8 several strips 85 are provided on the back side of the holder. These strips can be magnetic to secure the holder to a metallic surface, adhesive to secure the holder to any stickable surface, VELCRO to adhere to appropriate surfaces, of any other suitable securing form. In this manner, the holder can be mounted in any orientation including vertical. The pad will remain intact and within the holder by virtue of the retaining means of the present invention as detailed above.

FIG. 9 illustrates common rubber feet 87 attached to the back of the holder to allow the holder to retain its position when placed on a horizontal or near horizontal surface. The degree of serviceable tilt of the surface will depend on the frictional interaction of the feet and the surface. The degree of tilt will not be limited by the retention of the pad within the holder.

It is to be understood that the novel holder and dispenser described herein can be provided with or without the well known self-stick pad with which it is intended to be used. For example, the holder could be supplied with either the hook or the loop fastener means sewn or adhesively secured in its intended operating position on the upstanding wall 13 of FIG. 1A. The complementary loop or hook fastener could be supplied in engagement with the fastener which is attached to wall 13, but with its adhesive backing covered by a protective cover. The end user would supply the self-stick pad, would remove the protective cover from the complementary fastener, and would then urge the spine of the self-stick pad against the exposed adhesive surface. The adhesive on the surface preferably would be designed to be more aggressive than the hook and loop retention means so that removal of the pad of self-stick notes before exhaustion would bring with it its associated loop or hook retention means. It is to be understood that various other fastener means could be used, such as two-sided adhesives, dual locking fasteners other than hook and loop, and such other two sided or dual locking fasteners as are well known in the art.

It will be understood that the above description of the present invention is susceiptible to various modifications, changes and adaptations, and the same are intended to be comprehended within the meaning and range of equivalents of the appended claims.

What is claimed is:

1. A note pad holder for retaining a pad of self-stick sheets of paper in stacked configuration, said holder, comprising:

a planar body portion;

four upstanding walls extending from said body forming an essentially open box structure; and engagement structure attached to the interior surface of at least two of said walls, wherein the interior dimensions of said box are marginally greater than the exterior dimensions of said pad, thereby providing secure engagement between said pad and said engagement structure, said engagement structure including a component attachable to the spine of the pad for holding the individual sheets of the pad together.

2. A note pad holder for holding a pad having a plurality of self-stick sheets in a stacked configuration, said holder comprising:

a planar surface;

a first upstanding wall attached to said planar surface along a first edge thereof, and extending essentially perpendicular to said planar surface;

first engagement structure attached to said wall and having a first face extending adjacent said planar surface; and second engagement structure having a second face for cooperative engagement with said first face of said first engagement structure and a third face attached to a first edge of said pad, said third face holding the individual sheets of the pad together, said first engagement structure comprising a first hook or loop type engagement structure.

3. A note holder for holding a pad having a plurality of self-stick sheets in a stacked configuration, said holder comprising:

a planar surface for abutting a first sheet at a first lower end of said stack positioned against said surface;

a plurality of upstanding walls extending essentially perpendicular to said planar surface;

first engagement structure attached to a first one of said upstanding walls;

second engagement structure attached to a second one of said upstanding walls for engaging essentially all of said sheets of said pad along a second edge of said pad to retain said sheets in said stacked configuration; and third engagement structure including a component attached to a second edge of said pad for holding the sheets of the pad together, said third engagement structure having a first face of cooperative engagement with said first engagement means for resisting removal of said pad from said holder, said second engagement structure including a first hook or loop type engagement structure, and said third engagement structure including a second hook or loop type engagement structure complementary to said first hook or loop type engagement structure.

4. A note pad holder for a note pad having a plurality of self-stick sheets in a stacked configuration, said holder comprising:

a planar surface for abutting a first sheet at a first lower end of said stack positioned against said surface;

a plurality of upstanding walls extending essentially perpendicular to said planar surface;

first engagement structure attached to a first one of said upstanding walls;

second engagement structure attached to a second one of said upstanding walls for engaging essentially all of said sheets of said pad along a second edge of said pad to retain said sheets in said stacked configuration; and third engagement structure having a first surface for attachment to an edge of said pad for holding the sheets of the pad together and a second surface for cooperative engagement with said first engagement structure for resisting removal of said pad from said holder.

5. A note pad holder for retaining a pad of self-stick sheets of paper in stacked configuration, said holder comprising:

a base having a planar surface;

an upstanding wall attached to said base and extending essentially perpendicular to said planar surface;

first hook or loop type engagement structure attached to said wall with the engagement structure extending toward said planar surface; and second hook or loop type engagement structure complementary to said first engagement structure secured to the spine of the pad with said second engagement structure extending toward said upstanding wall for holding the individual sheets of said pad together and for holding said pad on said planar surface when said first and second engagement structures are in cooperative engagement to prevent the individual sheets from inadvertently disengaging from each other and to prevent the pad from inadvertently disengaging from said holder.

6. A dispenser for a stack of sheet material comprising sheets joined along a spine of the stack formed by a narrow band of pressure-sensitive adhesive on one side of each sheet adjacent one end which adhesive affords removing a single sheet from the stack by separating the adhesive coating end of the single sheet from the remaining sheets in the stack, said dispenser comprising:

a base having a planar surface;

an upstanding wall attached to said base and extending essentially perpendicular to said planar surface;

first hook or loop type engagement structure attached to said wall with the engagement structure extending toward said planar surface; and second hook or loop type engagement structure complementary to said first engagement structure secured to the spine of the stack of sheet material for holding the individual sheets of said stack together to prevent the sheets from inadvertently disengaging from each other and for holding said stack of sheet material on said planar surface when said first and second engagement structure are in cooperative engagement to prevent said stack from inadvertently disengaging from said dispenser.

7. A dispenser as set forth in claim 6, wherein is included a second upstanding wall perpendicular to said planar surface and to the first recited upstanding wall, and hook or loop type engagement structure attached to said second upstanding wall for engagement with a non-spinal edge of said stack of sheet material for holding said stack in place.

8. A dispenser as set forth in claim 7, wherein is included a third upstanding wall perpendicular to said planar surface and parallel to and spaced from said second upstanding wall, said third wall defining an area for holding a second stack of sheet material on said base adjacent to said first recited stack of sheet material.

9. A dispenser as set forth in claim 8, wherein is included a hook or loop engagement structure attached to said third upstanding wall for engagement with a non-spinal edge of said second stack of sheet material for holding said stack in place.

10. A dispenser for a stack of self-stick sheet material comprising sheets joined along a spine of the stack formed by a narrow band of pressure-sensitive adhesive on one side of each sheet adjacent one end thereof, which adhesive affords removing a single sheet from the stack by separating the adhesive coated end of the single sheet from the remaining sheets in the stack, said dispenser comprising:

a base having a planar surface;

an upstanding wall attached to said base and extending essentially perpendicular to said planar surface; and engagement structure attached to said wall with the engagement structure extending toward said planar surface; and second engagement structure complementary to said first engagement structure secured to the spine of the stack of sheet material, said engagement structure including a first component which is attached to an edge of a pad for holding the individual sheets of said stack together to prevent the sheets from inadvertently disengaging from each other and a second component for holding said stack of sheet material on said planar surface when said first and second engagement structures are in cooperative engagement.

11. A dispenser for a stack of self-stick sheet material comprising sheets joined along a spine of the stack formed by a narrow band of pressure-sensitive adhesive on one side of each sheet adjacent one end thereof, which adhesive affords removing a single sheet from the stack by separating the adhesive coating end of the single sheet from the remaining sheets in the stack, said dispenser comprising:

a base having a planar surface;

an upstanding wall attached to said base and extending essentially perpendicular to said planar surface; and engagement structure to be positioned between said wall and the spine of the stack of sheet material, said engagement structure including a first surface to be attached to the spine of said stack for holding the individual sheets of said stack together to prevent the sheets from inadvertently disengaging from each other and a second surface for holding said stack of sheet material on said planar surface when said first surface of said engagement structure is adhered to said wall and said second surface of said engagement structure is adhered to said spine.

12. A note pad holder for retaining a pad of self-stick sheets of paper in stacked configuration, said holder comprising:

a base having a planar surface;

an upstanding wall attached to said base and extending essentially perpendicular to said planar surface; and engagement structure attached either to said upstanding wall or to the spine of said stack of sheet material or to both for holding said stack of sheet material on said planar surface when said stack is placed against said upstanding wall, said enqagement structure including a component attachable to said spine for holding the individual sheets of said stack together to prevent the sheets from inadvertently disengaging from each other.

13. A note pad holder as set forth in claim 12, wherein said engagement structure comprises a two-sided adhesive strip.

14. A note pad holder as set forth in claim 12, wherein said engagement structure comprises a hook or loop type fastener.

15. A dispenser for a stack of self-stick sheet material comprising sheets joined along a spine of the stack formed by a narrow band of pressure-sensitive adhesive on one side of each sheet adjacent one end, which adhesive affords removing a single sheet from the stack by separating the adhesive coated end of the single sheet from the remaining sheets in the stack, said dispenser comprising:

a base having a planar surface;

an upstanding wall attached to said base and extending essentially perpendicular to said planar surface;

first hook or loop type engagement structure attached to said wall with the engagement structure extending toward said planar surface; and second hook or loop type engagement structure complementary to and in engagement with said first engagement structure, said second engagement structure including a component adapted to be secured to the spine of the stack of sheet material for holding the individual sheets of said stack together to prevent the sheets from inadvertently disengaging from each other, said first and second structures cooperating for holding said stack of sheet material on said planar surface when said first and second engagement structures are in cooperative engagement to prevent said stack from inadvertently disengaging from said dispenser.

* * * * *